United States Patent [19]

Horgan et al.

[11] 4,232,102

[45] Nov. 4, 1980

[54] IMAGING SYSTEM

[75] Inventors: Anthony M. Horgan, Pittsford; Richard W. Radler, Jr., Marion, both of N.Y.

[73] Assignee: Xerox Corporation, Stamford, Conn.

[21] Appl. No.: 40,332

[22] Filed: May 18, 1979

Related U.S. Application Data

[63] Continuation-in-part of Ser. No. 833,130, Sep. 14, 1977, abandoned.

[51] Int. Cl.[3] ..... G03G 5/087; G03G 5/14

[52] U.S. Cl. ..... 430/58; 430/59; 430/95

[58] Field of Search ..... 430/84, 95, 59, 58

[56] References Cited

U.S. PATENT DOCUMENTS

| | | | |
|---|---|---|---|
| 2,739,079 | 3/1956 | Keck | 427/76 |
| 3,077,306 | 2/1963 | Blakney et al. | 430/84 X |
| 3,685,989 | 8/1972 | Galen | 430/95 X |
| 3,911,091 | 10/1975 | Karam et al. | 430/84 X |
| 3,926,762 | 12/1975 | Goldstein | 204/192 |
| 3,961,953 | 6/1976 | Millizoni et al. | 427/124 X |
| 3,981,728 | 9/1976 | Jones | 430/84 |

FOREIGN PATENT DOCUMENTS

| | | | |
|---|---|---|---|
| 43-16198 | 7/1968 | Japan | 430/58 |

*Primary Examiner*—Roland E. Martin, Jr.
*Attorney, Agent, or Firm*—Harvey M. Brownrout; Peter H. Kondo; James Paul O'Sullivan

[57] ABSTRACT

An imaging member comprising a layer of particulate photoconductive material dispersed in an organic resinous binder, said photoconductive material comprising trigonal selenium containing a mixture of an alkali metal selenite and an alkali metal carbonate. This layer can be the charge generation layer of an imaging member also having a charge transport layer in contact therewith.

16 Claims, 6 Drawing Figures

THICKNESS 25 MICRONS
CHARGE DENSITY $1.2 \times 10^3$ C/M$^2$

| SAMPLE NUMBER | CONC. NaOH (NORMALITY) | SURFACE POTENTIAL AT 0.06 SECS. AFTER CHARGING ($V_1$) | | SURFACE POTENTIAL AT 0.22 SECS. AFTER CHARGING ($V_2$) | SURFACE POTENTIAL AT 0.66 SECS. AFTER CHARGING ($V_4$) | PERCENTAGE $\frac{V_2-V_4}{V_2} \times 100$ | Na WT % |
|---|---|---|---|---|---|---|---|
| 1. | 0N | RESTED | 1280 | 1220 | 1140 | 8 | 0.002 |
| | | FATIQUED | 1100 | 920 | 770 | 16 | |
| 2. | 0.01 N | RESTED | 1080 | 1000 | 960 | 4 | 0.015 |
| | | FATIQUED | 1090 | 980 | 910 | 7 | |
| 3. | 0.05 N | RESTED | 1100 | 1040 | 1010 | 3 | 0.1 |
| | | FATIQUED | 1120 | 1040 | 1010 | 3 | |
| 4. | 0.1 N | RESTED | 1170 | 1110 | 1090 | 2 | 0.1 |
| | | FATIQUED | 1180 | 1120 | 1080 | 4 | |
| 5. | 0.2N | RESTED | 1160 | 1090 | 1080 | 1 | 0.3 |
| | | FATIQUED | 1180 | 1120 | 1080 | 4 | |
| 6. | 0.6N | RESTED | 1260 | 1200 | 1190 | 1 | 0.80 |
| | | FATIQUED | 1300 | 1210 | 1190 | 2 | |
| 7. | 2.4N | RESTED | 1250 | 1200 | 1200 | 0 | 6.8 |
| | | FATIQUED | 1300 | 1240 | 1240 | 0 | |
| 8. | 4.8N | RESTED | 1300 | 1240 | 1230 | 1 | 12.0 |
| | | FATIQUED | 1340 | 1290 | 1280 | 1 | |

FIG. 5

IMAGING SYSTEM

This is a continuation-in-part application of Ser. No. 833,130, filed Sept. 14, 1977 now abandoned.

BACKGROUND OF THE INVENTION

This invention relates in general to xerography and more specifically to a novel photosensitive device.

Vitreous and amorphous selenium is a photoconductive material which has had wide use as a reusable photoconductor in commercial xerography. However, its spectral response is limited largely to the blue-green portion of the visible spectrum, i.e. below 5200 angstrom units.

Selenium also exists in a crystalline form known as trigonal or hexagonal selenium. Trigonal selenium is well known in the semiconductor art for use in the manufacture of selenium rectifiers.

In the past, trigonal selenium was not normally used in xerography as a photoconductive layer because of its relatively high electrical conductivity in the dark, although in some instances, trigonal selenium can be used in a binder configuration in which the trigonal selenium particles are dispersed in the matrix of another material such as an electrically active organic material such as vitreous selenium.

It is also known that a thin layer of trigonal selenium overcoated with a relatively thick layer of electrically active organic material, forms a useful composite photosensitive member which exhibits improved spectral response and increased sensitivity over conventional vitreous selenium-type photoreceptors. This device and method are described in U.S. Pat. No. 3,961,953 to Millonzi et al.

It is known that when using trigonal selenium whether it be dispersed in a binder or used as a generation material in a composite photoconductive device that the trigonal selenium exhibits a high dark decay and high dark decay after the photoreceptor has been cycled in a xerographic process. This is referred to as fatigue dark decay. Also, after cycling the photoreceptor in a xerographic process, the photoreceptor will not accept as much charge as it did initially.

As mentioned, fatigue dark decay is defined as after the member, i.e. photoreceptor, has been erased at least one time during a xerographic cycle, then the member is recharged and the dark decay is again examined. This dark decay is called fatigued dark decay.

PRIOR ART STATEMENT

U.S. Pat. No. 3,685,989 to Galen discloses a photoconductive layer which comprises vitreous selenium or a selenium-arsenic alloy which is doped with a small amount of sodium, lithium, potassium, rubidium or cesium. The selenium is doped in order to convert an essentially bipolar photoreceptor to an essentially ambipolar photoreceptor. In this patent, the starting material is sodium doped amorphous selenium which is then evaporatively deposited on a suitable substrate. The final photoconductive plate is sodium doped vitreous selenium on an aluminum drum.

U.S. Pat. No. 3,077,386 to Blakney et al describes a technique for treating amorphous selenium with a member selected from the group consisting of iron, chromium, ferrous sulfide, titanium, aluminum, nickel and alloys and mixtures thereof. Other materials which can be employed are zinc and calcium. In this technique the treating material, e.g. iron, is merely present during the evaporation of amorphous selenium onto a suitable photoreceptor substrate e.g. aluminum. The treating material must be stable and nonvolatile at least at the melting point of selenium. Thus, the treating material is not present in the amorphous selenium after vapor deposition thereof.

As taught in the prior art, trigonal selenium used as a photoconductive material in a xerographic process is not predictable from knowing that vitreous or amorphous selenium is a good photoconductive material. As taught in Keck, U.S. Pat. No. 2,739,079, trigonal selenium is quite conductive and would be unsuitable as a generating material. Japanese Publication No. 16,198 of 1968 of Japanese (M. Hayashi) application 73,753 of November 20, 1968, assigned to Matsushita Electric Industrial Company also discloses that one should not use a highly conductive photoconductive layer as a charge generation material in a multi-layered device comprising a charge generation layer and an overlayer of charge transport material. Therefore, since Keck, U.S. Pat. No. 2,739,079 teaches that trigonal selenium is highly conductive, it was unobvious that trigonal selenium could be used as a photoconductive material in a xerographic device merely because vitreous or amorphous selenium was a good photoconductive material for use in a xerographic device. Therefore, the vitreous or amorphous selenium prior art is not analogous prior art for use in teaching that trigonal selenium may act as vitreous or amorphous selenium when used in xerographic devices.

U.S. Pat. No. 3,926,762 discloses a method of making a photoconductive imaging device which comprises directly depositing a thin layer of trigonal selenium onto a supporting conductive substrate.

U.S. Pat. No. 3,961,953 discloses a method of making a photosensitive imaging device which comprises vacuum evaporating a thin layer of vitreous selenium onto a supporting substrate, forming a relatively thicker layer of electrically active organic material over the vitreous selenium layer. This step is followed by heating the member to an elevated temperature for a sufficient time to convert the vitreous selenium into the crystalline trigonal form.

OBJECTS OF THE INVENTION

It is, therefore, an object of this invention to provide a novel photosensitive device adapted for cyclic imaging by the xerographic process which overcomes the above-noted disadvantages.

It is a further object of this invention to provide trigonal selenium treated so as to control dark decay.

It is a further object of this invention to utilize this trigonal selenium in photosensitive devices in order to improve cyclic charge acceptance and control and improve dark decay both initially and after cycling the member in a xerographic process.

SUMMARY OF THE INVENTION

The foregoing objects and others are accomplished in accordance with this invention by providing a photosensitive member, i.e. imaging member, which comprises a layer of particulate trigonal selenium dispersed in an organic resinous binder. The trigonal selenium contains a mixture of an alkali metal selenite and an alkali metal carbonate. The proportion of alkali metal selenite to carbonate ranges from 90 to 10 parts by weight to 10 to 90 parts by weight. The total weight of the selenite and carbonate is from about 0.01 to about 12.0% by weight based upon the weight of the trigonal selenium. The term "alkali metal" is used in its usual sense to include sodium, lithium, potassium, rubidium and cesium. This modification of the trigonal selenium prevents the trigonal selenium from exhibiting unacceptable and undesirable amounts of dark decay either before charging and discharging of the member, or after the member has been through a complete xerographic process, that is, charged and erased and then recharged in the dark.

Typical applications of the invention include as mentioned above a single photoconductive layer having trigonal selenium in particulate form containing a mixture of alkali metal selenite and carbonate dispersed in an organic resinous binder. This may be used as a photosensitive device itself. Another typical application of the invention includes a photosensitive member which has at least two operative layers. The first layer comprises the above-mentioned single photoconductive layer. This layer is capable of photogenerating charge carriers and injecting these photogenerated charge carriers into a contiguous or adjacent charge carrier transport layer. The second layer is a charge carrier transport layer which may comprise a transparent organic polymer or a nonpolymeric material which when dispersed in an organic polymer results in the organic polymer becoming active, i.e. capable of transporting charge carriers. The charge carrier transport material should be substantially nonabsorbing to visible light or radiation in the region of intended use, but which is "active" in that it allows the injection of photogenerated charge carriers e.g. holes, from the particulate trigonal selenium layer and allows these charge carriers to be transported through the active layer to selectively discharge the surface charge on the free surface of the active layer.

It is not the intent of this invention to restrict the choice of active materials to those which are transparent in the entire visible region. For example, when used with a transparent substrate, imagewise exposure may be accomplished through the substrate without the light passing through the layer of active material, i.e. charge transport layer. In this case, the active layer need not be nonabsorbing in the wavelength region of use. Other applications where complete transparency is not required for the active material in the visible region include the selective recording of narrow-band radiation such as that emitted from lasers, spectral pattern recognition, and possible functional color xerography such as color coded form duplication.

Another embodiment of the instant invention may include an imaging member having a first layer of electrically active charge transport material contained on a supporting substrate, a photoconductive layer of the instant invention overlying the active layer and a second layer of electrically active charge transport material overlying the photoconductive layer. This member is more fully described in U.S. Pat. No. 3,953,207, the entire contents of which is hereby incorporated herein by reference.

Another typical application of the invention includes a photosensitive member which may comprise a photoconductive insulating layer comprising a matrix material of insulating organic resinous material and particulate trigonal selenium containing a mixture of alkali metal selenite and carbonate. Substantially all of this particulate trigonal selenium is in substantially particle-to-particle contact forming a multiplicity of interlocking trigonal selenium paths through the thickness of the layer. The trigonal selenium paths being present in a volume concentration, based on the volume of the layer, of from about 1 to 25 percent.

In general, the advantages of the invention will become apparent upon consideration of the following disclosure of the invention; especially when taken in conjunction with the accompanying drawings wherein:

BRIEF DESCRIPTION OF THE DRAWINGS

FIG. 5 illustrates rested dark decay and fatigue dark decay of photoreceptors containing trigonal selenium both modified and unmodified as the photoconductive material.

DETAILED DESCRIPTION OF THE DRAWINGS

Figure 1:
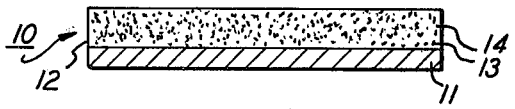
FIG. 1 is a schematic illustration of one of the members of the instant invention which comprises particulate trigonal selenium randomly dispersed in a resinous binder overlying a substrate.

For a better understanding of the Figures, several terms should be defined. The term "rested dark decay" when used in this application means that it is the amount of voltage drop, i.e. surface potential drop, of a member which has been rested and then charged initially to an initial surface potential, measured in voltage, and then allowed to remain in the dark. The drop in potential is measured 0.06 seconds after charging, 0.22 seconds after charging, and 0.66 seconds after charging. This "rested dark decay" means that the photoreceptor has been rested in the dark for at least 30 minutes prior to testing i.e. cycling in a xerographic mode.

"Fatigue dark decay" means, for purpose of this application, a drop in surface potential 0.06 seconds after charging, then after 0.22 seconds and then after 0.66 seconds. These measurements are made while the photoreceptor remains in the dark. "Fatigue dark decay" further means that the photoreceptor has been cycled at least one time through a xerographic cycle and then discharged, i.e. erased, and then is tested before the photoreceptor has rested, preferably before 30 minutes has passed after charging the photoreceptor. The process speed of the photoreceptor is 30 inches per second.

Referring to FIG. 1, reference character 10 designates an imaging member which comprises a supporting substrate 11 having a binder layer 12 thereon. Substrate 11 is preferably comprised of any suitable conductive material. Typical conductors comprise aluminum, steel, nickel, brass or the like. The substrate may be rigid or flexible and of any conventional thickness. Typical substrates include flexible belts of sleeves, sheets, webs, plates, cylinders and drums. The substrate or support may also comprise a composite structure such as a thin conductive coating contained on a paper base; a plastic coated with a thin conductive layer such as aluminum, nickel or copper iodine; or glass coated with a thin conductive coating of chromium or tin oxide.

In addition, if desired, an electrically insulating substrate may be used. In this case, the charge may be placed upon the insulating member by double corona charging techniques well known or disclosed in the art. Other modifications using an insulating substrate or no substrate at all include placing the imaging member on a conductive backing member or plate in charging the surface while in contact with said backing member. Subsequent to imaging, the imaging member may then be stripped from the conductive backing.

Binder layer 12 contains trigonal selenium particles 13 which contain a mixture of alkali metal selenite, e.g. $Na_2SeO_3$ and alkali metal carbonate, e.g. $Na_2CO_3$ in an amount of from about 0.01 to about 12.0% by weight based on the weight of the trigonal selenium. The trigonal selenium particles are dispersed randomly without orientation in binder 14.

Binder material 14 may comprise any electrically insulating resin such as those disclosed in Middleton et al U.S. Pat. No. 3,121,006, the entire contents of which are hereby incorporated by reference. When using an electrically inactive or insulating resin, it is essential that there be particle-to-particle contact between the photoconductive particles. This necessitates that the photoconductive material be present in an amount of at least about 15% by volume of the binder layer with no limit on the maximum amount of photoconductor in the binder layer. If the matrix or binder comprises an active material, e.g. polyvinyl carbazole, the photoconductive material need only to comprise about 1% or less by volume of the binder layer with no limitation on the maximum amount of photoconductor in the binder layer. The thickness of binder layer 12 is not critical. Layer thicknesses from about 0.05 to 40.0 microns have been found to be satisfactory.

Binder material 14 may also comprise Saran ®, available from Dow Chemical Company, which is a copolymer of polyvinyl chloride and polyvinylidene chloride; or polystyrene and polyvinyl butyral polymers.

The preferred additive materials are sodium selenite and sodium carbonate. The most preferred total amount of these materials is from about 0.01 to about 1.0% by weight each present in approximately equal parts by weight. This is the most preferred amounts when using binders, such as polyvinylcarbazole. However, this amount may vary if binders, such as electrically inactive binders, are used. Preferably there may be an adhesive charge blocking layer between the substrate and the charge generation layer.

The preferred size of the particulate trigonal selenium particles is from about 0.01 micron to about 10 microns in diameter. The more preferred size of the trigonal selenium particles is from about 0.1 microns to about 0.5 microns in diameter.

Figure 2:
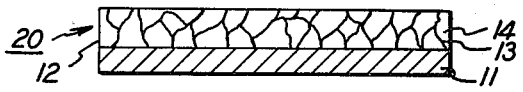
FIG. 2 is a schematic illustration of one of the members of the instant invention wherein the particulate trigonal selenium is geometrically dispersed within an electrically insulating organic binder. This layer overlies the substrate.

In another embodiment of the instant invention, the structure of FIG. 1 is modified to insure that the trigonal selenium particles are in the form of continuous paths or particle-to-particle chains through the thickness of binder layer 12. This embodiment is illustrated by FIG. 2 which shows the trigonal selenium particles 13 in the form of particle-to-particle chains. Layer 12 of FIG. 2 more specifically may comprise trigonal selenium particles 13 in a multiplicity of interlocking photoconductive continuous paths through a binder material 14, the photoconductive paths being present in a volume concentration based on the volume of the layer, of from about 1–25%. A further alternative for layer 12 of FIG. 2 comprises trigonal selenium material in substantially particle-to-particle contact in the layer in a multiplicity of interlocking photoconductive paths through the thickness of the member, the photoconductive paths being present in a volume concentration, based on the volume of the layer, of from about 1–25%.

Figure 3:
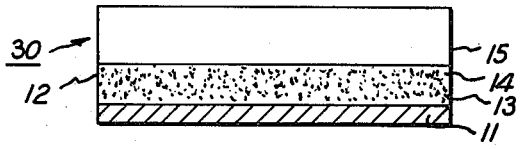
FIG. 3 is a schematic illustration of one of the members of the instant invention illustrating a composite photoreceptor comprising a charge carrier generation layer overcoated with a charge transport layer. The charge carrier generation layer comprises the selenite and carbonate modified trigonal selenium dispersed in an organic resinous binder as the charge carrier generation layer.

FIG. 3 designates imaging member 30 in the form of an imaging member which comprises a supporting substrate 11 having a binder layer 12 thereon, and a charge transport layer 15 positioned over binder layer 12. Substrate 11 may be of the same material as described for use in FIG. 1. Binder layer 12 may be of the same configuration as and contain the same material as binder layer 12 described in FIG. 1.

Active layer 15 may comprise any suitable transparent organic polymer or nonpolymeric material capable of supporting the injection of photo-generated holes and electrons from the trigonal selenium binder layer and allowing the transport of these holes or electrons through the organic layer to selectively discharge the surface charge.

Polymers having this characteristic, i.e. capability of transporting holes have been found to contain repeating units of a polynuclear aromatic hydrocarbon which may also contain heteroatoms such as for example, nitrogen, oxygen or sulphur. Typical polymers include poly-N-vinyl carbazole (PVK); poly-1-vinyl pyrene (PVP); poly-9-vinyl anthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; and N,N'-diphenyl-N,N'-bis(3-methylphenyl)-2,2'-dimethyl-1,1'-biphenyl-4,4'-diamine.

The active layer not only serves to transport holes or electrons, but also protects the photoconductive layer from abrasion or chemical attack and therefore extends the operating life of the photoreceptor imaging member.

The reason for the requirement that the active layer should be transparent is that most of the incident radiation is utilized by the charge carrier generator layer 12 for efficient photogeneration.

Charge transport layer 15 will exhibit negligible, if any, discharge when exposed to a wavelength of light useful in xerography, i.e., 4000 angstroms to 8000 angstroms. Therefore, charge transport layer 15 is substantially transparent to radiation in a region in which the photoconductor is to be used. Therefore, active layer 15 is a substantially nonphotoconductive material which supports an injection of photogenerated holes from the generation layer 12.

When used with a transparent substrate, imagewise exposure may be accomplished through the substrate without light passing through the layer of active material. In this case, the active material need not be nonabsorbing in the wavelength region of use.

The active layer 15 which is employed in conjunction with the generation layer 12 in the instant invention is a material which is an insulator to the extent that electrostatic charge placed on the active transport layer is not conducted in the absence of illumination, i.e. a rate sufficient to prevent the formation and retention of an electrostatic latent image thereon.

In general, the thickness of the active layer should be from about 5–100 microns, but thicknesses outside this range can also be used. The ratio of the thickness of the active layer 15 to the charge generation layer 12, should be maintained from about 2:1 to 200:1 and in some instances as great as 400:1. However, ratios outside this range can also be used.

Figure 4:
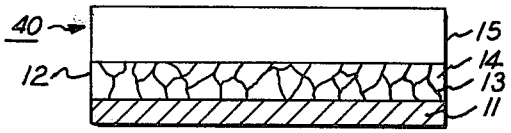
FIG. 4 is a schematic illustration of one embodiment of a device of the instant invention. A composite photoreceptor is disclosed comprising a charge carrier transport layer and a charge carrier generation layer. The charge carrier generation layer comprises the selenite and carbonate modified particulate trigonal selenium geometrically dispersed in an insulating binder.

In another embodiment of the instant invention, the structure of FIG. 3 is modified to insure that the alkali metal selenite-carbonate modified trigonal selenium particulate material is in the form of continuous chains through the thickness of binder layer 12. This embodiment is illustrated by FIG. 4 in which the basic structure and materials are the same as those of FIG. 3, except the trigonal selenium particulate material 13 is in the form of continuous chains. The same as illustrated in FIG. 2 for the particulate material 13.

In reference to FIGS. 3 and 4, the active layer 15 may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

One of the preferred embodiments of this invention comprise layer 15 of FIGS. 3 and 4 as an electrically active layer which comprises an electrically inactive resinous material e.g. a polycarbonate made electrically active by the addition of one or more of the following compounds: N,N'-diphenyl-N,N'-bis(phenylmethyl)-[1,1'-biphenyl]-4,4'-diamine; N,N'-diphenyl-N,N'-bis(alkylphenyl)-[1,1'-biphenyl]-4,4'-diamine; N,N,N',N'-tetraphenyl-[2,2'-dimethyl-1,1'-biphenyl]-4,4'-diamine; N,N,N',N'-tetra-(3-methylphenyl)-[2,2'-dimethyl-1,1'-biphenyl]-4,4'-diamine; and N,N'-diphenyl-N,N'-bis(3-methylphenyl)-[2,2'-dimethyl-1,1'-biphenyl]4,4'-diamine.

In another embodiment, the structures of FIGS. 3 and 4 can be modified so as to have utility with the imaging process described in U.S. Pat. No. 3,041,167. This modification involves the following structural arrangement: (1) any suitable support e.g. organic, inorganic; (2) on this support is deposited an injecting contact e.g. carbon, selenium dioxide, gold, etc; (3) in intimate electrical contact with the injecting contact is the transport layer of the instant invention e.g. polycarbonate containing any one or more of the charge transport molecules disclosed herein; (4) the selenite-carbonate modified trigonal selenium charge generating layer in contact with the charge transport layer; and (5) an electrically insulating layer deposited on the charge generating layer. The electrically insulating layer can be an organic polymer or copolymers such as polyethylene terephthalate polyethylene, polypropylene, polycarbonate, polyacrylates, etc. The thickness of the polymer layer is not critical and can conveniently range from 0.01–200 microns. There must be a charge injecting contact between the substrate and the charge transport layer. If this requirement is satisfied, the particular material employed is not important.

FIGS. 1 and 2 also can be modified by depositing a dielectric layer e.g. an organic polymer, on the dispersed trigonal selenium layer. Many imaging methods can be employed with this type of photoconductor. Examples of these methods are described by P. Mark in Photographic Science and Engineering, Vol. 18, No. 3, pp. 254–261, May/June 1974.

The imaging methods require the injection of majority carriers or photoconductors possessing ambipolar properties. Also, such methods may require a system where bulk absorption of light occurs.

In all of the above charge transport layers, the activating compound which makes the electrically inactive polymeric material electrically active should be present in amounts of from about 15 to about 75 percent by weight, preferably from about 25 to 50 percent by weight.

The preferred electrically inactive resinous materials are polycarbonate resins. The preferred polycarbonate resins have a molecular weight from about 20,000 to about 100,000, more preferably from about 50,000 to about 100,000.

The materials most preferred as the electrically inactive resinous material is poly(4,4'-dipropylidene-diphenylene carbonate) with a molecular weight of from about 35,000 to about 40,000, available as Lexan® 145 from General Electric Company; poly(4,4'-isopropylidene-diphenylene carbonate) with a molecular weight of from about 40,000 to about 45,000, available as Lexan® 141 from the General Electric Company; a polycarbonate resin having a molecular weight of from about 50,000 to about 100,000, available as Makrolon® from Farbenfabricken Bayer A.G. and a polycarbonate resin having a molecular weight of from about 20,000 to about 50,000, available as Merlon® from Mobay Chemical Company.

Alternatively, as mentioned, active layer 15 may comprise a photogenerated electron transport material, for example, trinitrofluorenone, polyvinyl carbazole/-trinitrofluorenone in a 1:1 mole ratio, etc.

FIG. 5 (sample 1) shows the rested dark decay and the fatigue dark decay of a photoreceptor containing trigonal selenium without sodium selenite and sodium carbonate as the photoconductive material dispersed in an electrically active binder as the generator layer which is overcoated with a transport layer. This member was made by the process as set forth in Example V. The negative corona charge density was about $1.2\times10^{-3}$ C/m$^2$ and the thickness of the member was about 25 microns. The member was rested in the dark for 15 hours prior to charging. Then the member was charged to a maximum of 1280 volts initially measured 0.06 seconds after charging. After 0.22 seconds, while the photoreceptor remained in the dark, its rested dark decay was 60 volts, i.e. the surface potential had dropped to 1220 volts. After 0.66 seconds the surface potential was 1140 volts indicating a dark decay of 140 volts.

As shown in FIG. 5, the fatigue dark decay was obtained by charging the member initially to a maximum of 1100 volts measured 0.06 seconds after charging. This is 180 volts less than the member was capable of being charged initially in the rested dark decay test. After the member remained in the dark for 0.22 seconds, it discharged to 920 volts which represents a fatigued dark decay of 180 volts. After 0.66 seconds, the member discharged to 770 volts, indicating a fatigue dark decay of 330 volts.

It is convenient to express this fatigue dark decay as a percentage of the ratio of the surface potential change between 0.22 seconds and 0.66 seconds and the surface potential at 0.22 seconds after charging. In sample 1, this amounts to 8% and 16% for the rested and fatigued dark decay, respectively.

As can be seen from FIG. 5, the volts of charge on the surface of the member initially, i.e. after 15 hours dark rest, is almost the same as the volts of charge on the surface of the member after a xerographic cycle for the doped members. However, there is a measurable difference in these surface potential values for the trigonal selenium not containing selenite and carbonate. In other words, the drop between the rested and the fatigued dark decay is high in the unmodified and low in the modified trigonal selenium.

In FIG. 5, (sample 1) i.e. unmodified trigonal selenium, shows 180, 300 and 370 volts difference, respectively, in the surface potential at 0.06 0.22 and 0.66 seconds after charging of the rested, versus the fatigued member. However, the samples containing selenite and carbonate, i.e. FIG. 5 (samples 2–8 made by the process of Example VI), showed almost no difference within experimental measurement error.

From FIG. 5 (samples 1–8), it is shown that by modifying trigonal selenium with sodium selenite and sodium carbonate the surface potential after fatigue is greater than the surface potential of the unmodified fatigued trigonal selenium containing photoreceptor. That is, the fatigued modified members accepted more charge, almost as much charge as these members accepted when rested, as compared to the fatigued unmodified member which accepted much less charge. The surface potential of the unmodified member becomes much less, much faster, than the surface potential of the modified members. Also both the rested and fatigue dark decay are more in the unmodified member after 0.06 seconds, 0.22 seconds and 0.66 seconds in the dark as compared to the rested and fatigued dark decay in the modified members.

Figure 6:
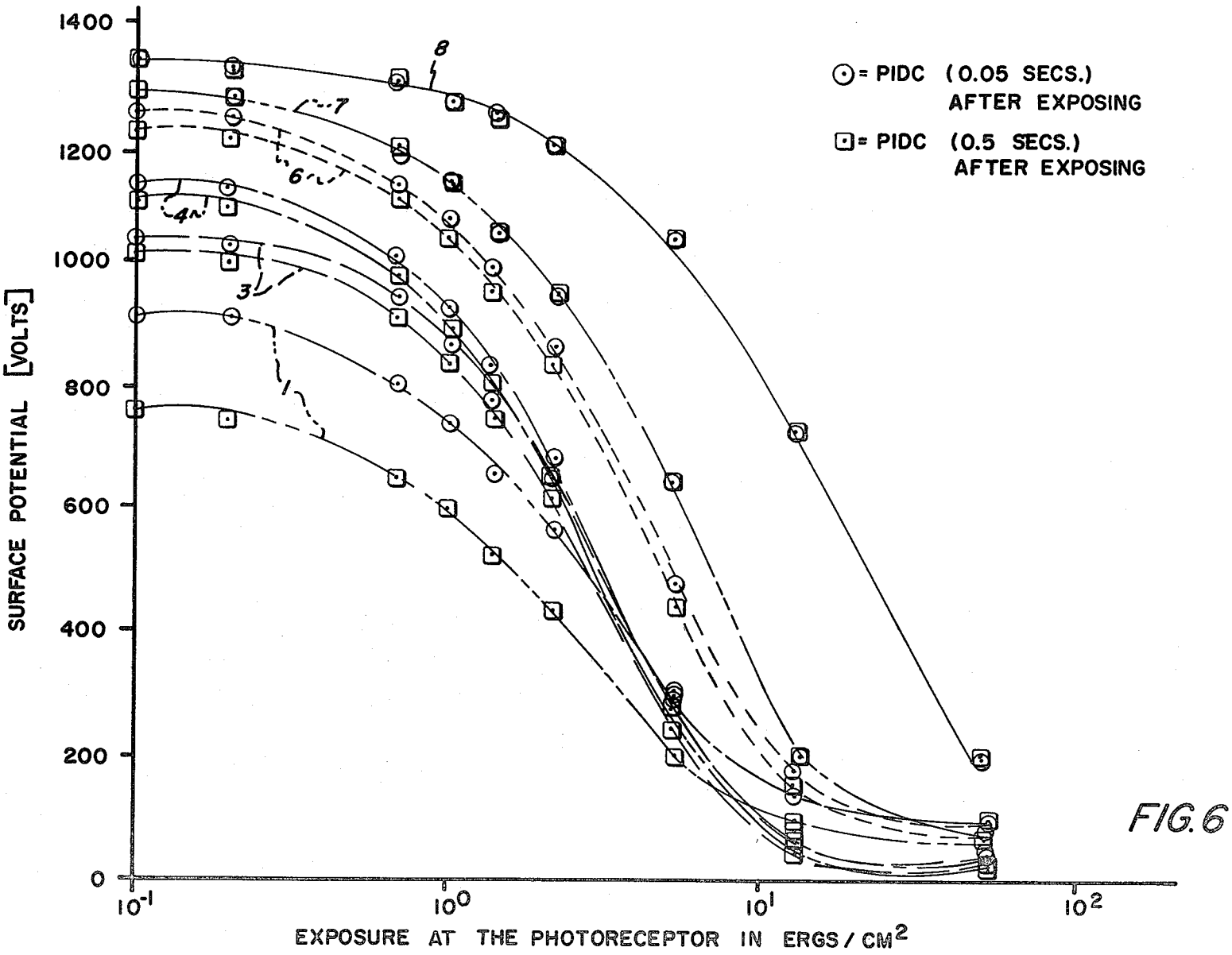
FIG. 6 illustrates the photoinduced discharge curves (PIDC) of the members illustrated in FIG. 5.

FIG. 6 shows the photo-induced discharge curves (PIDC) of members containing modified and unmodified trigonal selenium as the photoconductive material. These PIDC's show surface potential versus the exposure at the photoreceptor in Ergs/cm$^2$. The PIDC of each sample was taken at two different times, i.e. 0.06 seconds after exposing and 0.5 seconds after exposing. The exposure station is located 0.16 seconds after charging for a photoreceptor process speed of 30 inches per second. The PIDC's of samples 1, 3, 4, 6, 7 and 8 of FIG. 5 are shown in this Figure. The square points represent PIDC points 0.5 seconds after exposing and the round points represent PIDC points 0.06 seconds after exposing.

From FIG. 6, it is clear that the PIDC's of number 1 are unstable because they show a significant change with time. The PIDC's for numbers 3, 4, 6, 7 and 8 are stable with time. That is, the PIDC's vary only slightly with time between 0.06 seconds after exposing and 0.5 seconds after exposing. In fact, in number 7 and 8 the PIDC's show no variance since the PIDC for 0.06 seconds after exposing and the PIDC for 0.5 seconds after exposing were about the same. These curves are superimposed on each other. Therefore, by modifying the trigonal selenium contained in the photoreceptors, the dark decay is removed from the photoreceptors, or at the least controlled, resulting in the stabilization of the PIDC's of these modified members. If a machine were to use a photoreceptor in belt form and the photoreceptor being used contained unmodified trigonal selenium poor image quality would result. After flash exposure and advancement to the development zone, the leading edge of the latent image on the belt would go into the development zone before the trailing edge of the image. The PIDC at the leading edge of the photoreceptor will be different from the PIDC at the trailing edge, since the PIDC of this unmodified member changes as a function of time. Therefore, the latent image when developed would be unacceptable. The PIDC would unacceptably vary from one end to the image to the other. However, this effect will vary as a function of the photoreceptor process speed, i.e. the greater the speed, the greater the effect. This would not happen when using a photoreceptor containing modified trigonal selenium as the photoconductive material, since the PIDC's of these members do not change as a function time. The latter situation leads to good print characteristics.

As can be seen from the PIDC's of FIG. 6, all the sensitivities of the samples are a function of the sodium selenite and sodium carbonate weight percentage. In addition, the dark decay is also a function of the amount of these additives as shown by FIG. 5. Hence, depending on the additive level the PIDC's are stable and do not change with time.

A preferred method of introducing the sodium selenite and sodium carbonate to the trigonal selenium involves washing the trigonal selenium with sodium hydroxide.

The trigonal selenium, before the NaOH washing, contains less than 20 parts per million total sodium and less than 20 parts per million of other metal impurities. Typical levels of selenium dioxide and selenious acid are less than 250 parts per million.

The NaOH washing of the above defined trigonal selenium converts the selenium dioxide and selenious acid to sodium selenite and the hydroxide also reacts with some of the trigonal selenium itself yielding sodium selenite and sodium carbonate. The reaction is proposed to be as follows:

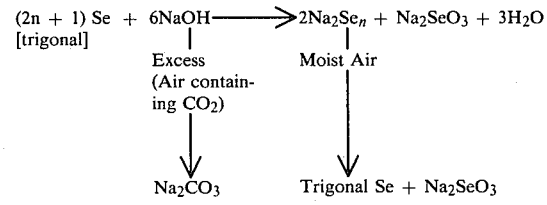

wherein n = 1–6

The amount of sodium selenite and sodium carbonate in association with the trigonal selenium may be varied by varying the sodium hydroxide concentration.

The excess sodium hydroxide is removed and depending on the amount of sodium selenite and carbonate left, this varies the electrical properties of the trigonal selenium. Preferred amounts of sodium selenite and carbonate range from a combined weight of 0.01 percent to 1.0 percent of approximately equal weight proportions, based on the total weight of trigonal selenium present. However, any amount between 0.01 to 12.0% by weight may be used.

In addition to NaOH, the following compound may also be employed: $NaHCO_3$, $Na_2CO_3$, $CH_3COONa$ and $Na_2SeO_3$. Generally, any Group 1a alkali metal salt, i.e. the salt of a strong base and a weak acid, may be employed. These salts are capable of hydrolysis, defined as the reaction of the salt with water to form the hydroxide. Similarly, the hydroxides and the salts of lithium, potassium, rubidium, and cesium may be used.

Preferably, the particulate trigonal selenium should be in the size range from about 0.01 micron to about 10 microns in diameter with the most preferred size being about 0.1 micron to 0.5 micron in diameter. This size is important the trigonal selenium will have a high surface to volume ratio. A relatively large amount of the sodium compounds may be placed on the surface of these small particles. This will control the surface component of dark decay.

The trigonal selenium particles comprise aggregates and agglomerates composed of many crystallites with cracks and crevasses therebetween. The average crystallite size is about 200 angstrom units. It is preferred that the compounds, e.g. the sodium, lithium, potassium, rubidium and cesium compounds, be deposited in these cracks or crevasses and on the surface of the crystallites. This helps control the bulk dark decay of the trigonal selenium particles. That is, getting the compounds into these cracks and crevasses helps control and relieve bulk charge trapping. Therefore, both the external and internal surface of the particles of trigonal selenium are being modified.

The following examples further specifically define the present invention with respect to a method of making the modified trigonal selenium containing photoconductive members. The percentages are by weight unless otherwise indicated. The examples below are intended to illustrate various preferred embodiments of the instant invention.

EXAMPLE I

Preparation of unmodified trigonal selenium.

Into a 500 milliliter Erlenmeyer flask fitted with a magnetic stirrer is placed 100 gms. of reagent grade sodium hydroxide dissolved in 100 milliliters of deionized water. When the solution is complete, 23.7 gms. of X-grade amorphous selenium beads available from Canadian Copper Refineries are added. The solution is stirred at 85° C. for five hours. Then deionized water is added to bring the total volume up to 300 milliliters. The solution is stirred for one minute. The heat is then removed and the solution allowed to digest at least for 18 hours.

The above solution is then filtered through a coarse fritted glass funnel into a vacuum glass containing 3700 milliliters of deionized water. The water should be swirling. The total volume is 4 liters. The solution is stirred for five minutes. Ten milliliters of 30 percent reagent grade hydrogen peroxide is added dropwise to the solution over a period of two minutes. The solution is stirred for an additional 30 minutes. Trigonal selenium is then precipitated out of the solution and permitted to settle. This results in the proper size trigonal selenium. The supernatent liquid is decanted and replaced with deionized water. This washing procedure is repeated until the resistivity of the supernatent equals that of the deionized water and the pH is 7. Then the trigonal selenium is filtered out on a No. 2 filter paper. The trigonal selenium is dried at 60° C. in a forced air oven for 18 hours. The sodium content of the final trigonal selenium powder is 20 ppm, other metal impurities are less than 20 ppm. The yield is 85 percent.

The reaction involved in the foregoing procedure is as follows:

$$\text{1. } \underset{\text{amorphous}}{(2n+1)Se} + 6NaOH \rightleftharpoons \underset{\substack{\text{sodium polyselenide}\\ n = 3-4}}{2Na_2[Se_n^{2-}]} + Na_2SeO_3 + 3H_2O$$

2. dilution with $H_2O$ $$\text{3. } Na_2[Se_n^{2-}] + 2H_2O_2 \longrightarrow {}^{n}Se + 2NaOH$$

$$\downarrow$$

trigonal

EXAMPLE II

Preparation of sodium doped trigonal selenium.

The trigonal selenium made by Example I or by any other technique may be used as the starting material. The trigonal selenium is thoroughly washed and before filtering, as much of the supernatent liquid as possible is decanted. The washing trigonal selenium is brought to a volume of four liters with a 0.6 normal (N) solution of sodium hydroxide. This solution should be swirled for ½ hour. The solids should be allowed to settle out and remain in contact with the sodium hydroxide solution for 18 hours. The supernatent liquid is decanted and retained. The treated trigonal selenium is filtered on a No. 2 filter paper. The retained supernatent liquid is used to rinse the beaker and funnel. The trigonal selenium is dried at 60° C. in a forced air oven for 18 hours. The total sodium selenite and sodium carbonate levels average approximately 1.0 percent by weight on an approximately equimolar basis based on the weight of the trigonal selenium. All other metal impurities are less than 30 ppm.

EXAMPLE III

Preparation of a member containing untreated trigonal selenium dispersed in an electrically active resinous binder.

A five mil aluminized Mylar® substrate is rinsed with methylene chloride. The aluminized Mylar® substrate is allowed to dry at ambient temperatures. In a glove box with the humidity less than 20 percent and the temperature at 82° F., a layer of ½ percent DuPont 49,000 adhesive, a polyester available from DuPont, in chloroform and trichloroethane 4 to 1 volume is coated onto the substrate with a Bird applicator. The wet thickness of the layer is ½ mil. This layer is allowed to dry for one minute in the glove box and ten minutes in a 100° C. oven.

A generator layer containing 20% by volume untreated trigonal selenium is prepared as follows:

Into a 2 ounce amber bottle is added 0.8 grams purified polyvinylcarbazole and 14 ml. of 1:1 tetrahydrofuran/toluene. Added to this solution is 100 grams of ⅛ inch stainless steel shot and 0.8 grams untreated trigonal selenium. The above mixture is placed in a ball mill for 72 hours. Then the solution is coated on the above interface layer with a Bird applicator. The wet thickness is ½ mil. Then this member is annealed at 100° C. in a vacuum for 18 hours. The dry thickness is 2 microns.

EXAMPLE IV

Preparation of a member containing sodium selenite and sodium carbonate treated trigonal selenium dispersed in an electrically active resinous binder.

A five mil aluminized Mylar® substrate is rinsed with methylene chloride. The aluminized Mylar® is allowed to dry at ambient temperature. In a glove box with humidity less than 20 percent and the temperature at 82° F., a layer of ½ percent DuPont 49,000 adhesive in chloroform and trichloroethane, 4 to 1 volume, is coated onto the aluminized Mylar® with a Bird applicator to a wet thickness of ½ mil. The coating is dried for 1 minute in the glove box and 10 minutes in a 100° C. oven. Alternatively, the aluminized Mylar® may be coated with a layer of ½ percent Monsanto B72A (polyvinylbutyral) in ethanol with a Bird applicator. The wet thickness is ½ mil. The layer is allowed to dry in a glove box for 1 minute and 10 minutes in 100° C. oven.

A generator layer containing 20 percent by volume treated trigonal selenium is prepared as follows:

Into a 2 ounce amber bottle is added 0.8 grams purified polyvinylcarbazole and 14 ml of 1:1 tetrahydrofuran/toluene. Added to this solution is 100 grams of ⅛ inch stainless steel shot and 0.8 grams treated trigonal selenium as prepared in Example II. The above mixture is placed on a ball mill for 72 hours. Then the solution is coated on the above interface layer with a Bird applicator. The wet thickness is ½ mil. Then this member is annealed at 100° C. in a vacuum for 18 hours. The dry thickness is 2 microns.

EXAMPLE V

A composite photoconductive member is prepared which comprises a generator layer containing untreated trigonal selenium which is overcoated with a transport layer.

A five mil aluminized Mylar® substrate is rinsed with $CH_2Cl_2$. This substrate is allowed to dry at ambient temperature. In a glove box with humidity less than 20 percent and the temperature at 82° F. the aluminized Mylar® substrate is coated with a layer of ½ percent DuPont 49,000 adhesive in $CHCl_3$ and trichloroethane at 4:1 volume with a Bird applicator. The wet thickness is ½ mil. The layer is allowed to dry for 1 minute in a glove box and 10 minutes in 100° C. oven.

A generator layer containing 20% by volume undoped trigonal selenium is prepared as follows:

Into a 2 ounce amber bottle is added 0.8 grams purified polyvinylcarbazole and 14 ml of 1:1 tetrahydrofuran/toluene. Added to this solution is 100 grams of ⅛ inch stainless steel shot and 0.8 grams untreated trigonal selenium as prepared in Example I. The above mixture is placed on a ball mill for 72 hours. Then the solution is coated on the above interface layer with a Bird applicator. The wet thickness is ½ mil. Then this member is annealed at 100° C. in a vacuum for 18 hours. The dry thickness is 2 microns.

The above generator layer is overcoated with a charge transport layer which is prepared as follows:

A transport layer containing 50 percent by weight Makrolon®, a polycarbonate resin having a molecular weight of from about 50,000 to about 100,000, available from Larbensabricken Bayer A.G., is mixed with 50 percent by weight N,N'-diphenyl-N,N'-bis(3-methylphenyl)-[1,1'-biphenyl]-4,4'-diamine. All of these components are placed into an amber bottle and dissolved in methylene chloride to give a 15% by weight solution. The mixture is coated to a dry 25 micron thickness layer on top of the generator layer using a Bird applicator. The humidity is equal to or less than 15 percent. The solution is annealed at 70° C. in a vacuum for 18 hours. The member is tested the same as the members as shown in FIGS. 5 and 6. The rested dark decay and the fatigue dark decay of this photoreceptor containing trigonal selenium without the sodium selenite and sodium carbonates as a photoconductive material dispersed in an electrically insulating resinous binder as a generating material overcoated with a charge transport material is tested as follows. The member is rested in the dark for 15 hours prior to charging. Then the member is charged to a maximum of 1280 volts initially measured at 0.06 seconds after charging. After 0.22 seconds while the photoreceptor remains in the dark, its rested dark decay is 60 volts, i.e. the surface potential dropped to 1220 volts. After 0.66 seconds, the surface potential is 1140 volts indicating a dark decay of 140 volts.

The fatigued dark decay is obtained by charging the member initially to a maximum of 1100 volts measured at 0.06 seconds after charging. This is 180 volts less than the member was capable of being charged initially in the rested dark decay test. After the member is retained in the dark for 0.22 seconds, it discharges to 920 volts, which represents a fatigued dark decay of 180 volts. After 0.66 seconds, the member discharges to 770 volts indicating a fatigued dark decay of 330 volts.

EXAMPLE VI

Preparation of a multilayered imaging member comprising a generation layer containing treated trigonal selenium overcoated with a transport layer.

A five mil aluminized Mylar® substrate is rinsed with methylene chloride. The substrate is allowed to dry at ambient temperature. In a glove box with the humidity less than 20 percent and the temperature at 82° F., the substrate is coated with a layer of ½ percent DuPont 49,000 adhesive in chloroform and trichloroethane, 4 to 1 volume, with a Bird applicator to a wet thickness of ½ mil. The layer is allowed to dry in a glove box for one minute and in a 100° C. oven for 10 minutes. Alternatively, the aluminized Mylar® may be coated with a layer of ½ percent Monsanto B72A (polyvinylbutyral) in ethanol with a Bird applicator. The wet thickness is ½ mil. The layer is allowed to dry in a glove box for 1 minute and 10 minutes in a 100° C. oven.

A charge generation layer containing 20 percent by volume of sodium selenite-sodium carbonate treated trigonal selenium is prepared as follows:

A 2 ounce amber bottle is provided and 0.8 gram purified polyvinylcarbazole, and 14 ml of 1:1 tetrahydrofuran/toluene is added to the bottle. To this solution is added 100 gms. of ½ inch stainless steel shot and 0.8 gm. of treated trigonal selenium as prepared in Example II.

This solution is placed on a ball mill for 72 hours. Then the solution is coated on the above interface layer with a Bird applicator. The wet thickness is ½ mil. Then this member is annealed at 100° C. in a vacuum for 18 hours. A dry thickness is formed which is 2 microns thick.

A charge transport layer is formed on the above charged generating layer. The charge transport layer comprises a 50—50 by weight solution of Makrolon ®, a polycarbonate resin having a molecular weight of from about 50,000 to about 100,000 available from Larbenfabricken Bayer A.G., and N,N'-diphenyl-N,N'-bis(3-methylphenyl)-[1,1'-biphenyl]-4,4'-diamine. All of these ingredients are placed in an amber bottle and dissolved in methylene chloride to give a 15% by weight solution. The components are coated with a Bird applicator to form a dry coating of 25 microns on top of the charge generation layer. The humidity is equal to or less than 15 percent. The solution is annealed at 70° C. in a vacuum for 18 hours.

The member is sample 6 and is tested as in FIG. 5 and FIG. 6. The rested dark decay and fatigue dark decay in the photoconductor which contains selenite carbonate modified trigonal selenium is tested. In order to illustrate the rested dark decay, the member is charged to a maximum of 1260 volts initially measured at 0.06 seconds after charging and after 0.22 seconds it discharges to 1200 volts, representing a rested dark decay of 60 volts. After 0.66 seconds it discharges to 1190 volts, representing a rested dark decay of 70 volts. The fatigue dark decay is shown by initially charging the member to a maximum of 1300 volts measured at 0.06 seconds after charging and after 0.22 seconds in the dark, the member discharges to 1210 volts, representing a fatigue dark decay of 90 volts. After 0.66 seconds the member discharges to 1190 volts, representing a fatigue dark decay of 110 volts.

Samples 2, 3, 4, 5, 7 and 8 also contained modified trigonal selenium prepared by the method of Example II, backwashed with 0.01 N, 0.05 N, 0.1 N, 0.2 N, 2.4 N and 4.8 N sodium hydroxide solution respectively, fabricated in the same manner as sample 6.

EXAMPLE VII

Fabrication of untreated trigonal selenium contained in a geometrically controlled photoreceptor.

A photoreceptor with geometrically controlled photoconductive material, i.e. untreated trigonal selenium, contained therein is prepared as follows:

The member contains 8 percent by volume untreated trigonal selenium. Into a 4 ounce clear glass bottle is added 2 ounces (vol.) $\frac{1}{8}$ inch stainless steel shot, 4.5 grams of untreated trigonal selenium as prepared in Example I and 18.75 ml of a 1:1 isopropyl alcohol-/isobutylalcohol. This is placed on a ball mill for 6 hours at 150 RPM. To this slurry is added 14.4 grams of spray dried Flexclad ®, a polyester available from Goodyear, and 30 ml of a 1:1 isopropylalcohol-/isobutylalcohol. This is ball milled for 18 hours at 150 RPM.

The slurry is filtered through a 100 mesh screen, then allowed to stand for 10 minutes to remove air bubbles. The slurry is coated on a 5 mil aluminum substrate with a 10 mil multiple clearance bar. This layer is dried for 3 hours at 50° C. It is then fused for 20 minutes at 175° C.

The trigonal selenium is in substantially particle-to-particle contact in said member in a multiplicity of interlocking paths or chains through the thickness of the layer. The untreated trigonal selenium paths or chains are present in a volume concentration, as mentioned, as 8 percent based on the volume of the layer.

The member is tested in the manner illustrated in FIGS. 5 and 6. However, this member is charged with positive corona. The untreated trigonal selenium containing member has a high dark discharge and an unstable PIDC as compared to members containing treated trigonal selenium as the photoconductive material.

EXAMPLE VIII

Fabrication of treated trigonal selenium contained in a geometrically controlled photoreceptor.

A photoreceptor with geometrically controlled photoconductive material contained therein is prepared as follows:

The member contains 8 percent by volume of selenite and carbonate treated trigonal selenium. Into a 4 ounce clear glass bottle is added 2 ounces (vol.) $\frac{1}{8}$ inch stainless steel shot, 4.5 grams of treated trigonal selenium as prepared in Example II and 18.75 ml of a 1:1 isopropylalcohol/isobutylalcohol. This is placed on a ball mill for 6 hours at 150 RPM. To this slurry is added 14.4 grams of spray dried Flexclad ®, a polyester available from Goodyear, and 30 mil of a 1:1 isopropylalcohol-/isobutylalcohol. This is ball milled from 18 hours at 150 RPM.

The slurry is filtered through a 100 mesh screen, then allowed to stand for 10 minutes to remove air bubbles. The slurry is coated on a 5 mil aluminum substrate with a 10 mil multiple clearance bar. This layer is dried for 3 hours at 50° C. It is then fused for 20 minutes at 175° C. The trigonal selenium is in substantially particle-to-particle contact in said member in a multiplicity of interlocking paths or chains through the thickness of the layer.

The member is tested in the manner shown in FIGS. 5 and 6. However, this member is charged with positive corona. The treated trigonal selenium containing member has a low dark discharge and a stable PIDC as compared to members containing untreated trigonal selenium as the photoconductive material.

What is claimed is:

1. An imaging member comprising a layer of particulate photoconductive material dispersed in an organic resinous binder, said photoconductive material comprising trigonal selenium containing a mixture of alkali metal selenite and alkali metal carbonate of from about 0.01 to about 12.0 percent total weight based on the weight of the trigonal selenium wherein ratio of the selenite to carbonate ranges from 90 to 10 parts by weight to 10 to 90 parts by weight.

2. The member according to claim 1 wherein the ratio of selenite to carbonate is approximately equal.

3. The member according to claim 2 wherein the alkali metal is sodium.

4. The member according to claim 3 wherein both the selenite and carbonate are present in about 0.01 to about 1.0 percent.

5. The member according to claim 4 wherein the size of the particulate trigonal selenium is from about 0.01 micron to about 10 microns in diameter.

6. The member according to claim 5 wherein the size of the particulate trigonal selenium is from about 0.1 micron to about 0.5 micron in diameter.

7. The member according to claim 1 wherein the member is overcoated with an electrically insulating organic resinous material.

8. An imaging member comprising a charge generation layer comprising a particulate photoconductive material comprising trigonal selenium dispersed in an organic resinous binder, said trigonal selenium containing a mixture of alkali metal selenite and alkali metal carbonate of from about 0.01 to about 12.0 percent total weight based on the weight of trigonal selenium wherein the ratio of the selenite to carbonate ranges from 90 to 10 parts by weight to 10 to 90 parts by weight and a contiguous charge transport layer, said photoconductive material exhibiting the capability of photogeneration of charge carriers and injection of said charge carriers and said charge transport layer being substantially nonabsorbing in the spectral region at which the photoconductive material generates and injects photogenerated charge carriers but being capable of supporting the injection of photogenerated charge carriers from said photoconductive material and transporting said charge carriers through said charge transport layer.

9. The member according to claim 8 wherein the photogenerated charge carriers are photogenerated holes.

10. The member according to claim 8 wherein the photogenerated charge carriers are photogenerated electrons.

11. The member according to claim 8 wherein the mole ratio of selenite to carbonate is approximately equal.

12. The member according to claim 11 wherein the alkali metal is sodium.

13. The member according to claim 12 wherein both the selenite and carbonate are present in about 0.01 to about 1.0 percent by weight.

14. The member according to claim 13 wherein the size of the particulate trigonal selenium is from about 0.01 micron to about 10 microns in diameter.

15. The member according to claim 14 wherein the size of the particulate trigonal selenium is from about 0.1 micron to about 0.5 micron in diameter.

16. The member according to claim 8 wherein a substrate has a charge injecting layer thereon, said charge transport layer deposited on said injecting layer, said charge generation layer of trigonal selenium in said organic binder deposited on said transport layer and an electrically insulating organic resinous layer deposited on said charge generation layer.

* * * * *